US005608940A

United States Patent [19]

Panyon, Jr.

[11] Patent Number: 5,608,940

[45] Date of Patent: Mar. 11, 1997

[54] COMBINATION TOOTHBRUSH AND STORAGE/DISPENSER APPARATUS AND METHOD OF MAKING THE SAME THEREOF

[75] Inventor: Larry A. Panyon, Jr., Scottsdale, Ariz.

[73] Assignee: L.A.P. Innovations, Inc., Scottsdale, Ariz.

[21] Appl. No.: 511,976

[22] Filed: Aug. 7, 1995

[51] Int. Cl.[6] ..... A47L 15/00

[52] U.S. Cl. ..... 15/105; 15/143.1; 132/311; 221/199

[58] Field of Search ..... 15/105, 143.1, 15/167.1; 132/308, 309, 311; 206/534, 538, 539; 221/2, 4, 82, 83, 86, 155, 199

[56] References Cited

U.S. PATENT DOCUMENTS

| | | | |
|---|---|---|---|
| D. 246,489 | 11/1979 | Cunningham | D4/18 |
| 793,259 | 6/1905 | Wilson | 15/105 |
| 1,290,545 | 1/1919 | Greaves . | |
| 1,364,188 | 1/1921 | Draenert | 132/311 |
| 2,294,001 | 8/1942 | Ritter | 206/42 |
| 2,367,019 | 1/1945 | Haag | 206/539 |
| 2,718,299 | 9/1955 | Atwater | 206/42 |
| 3,162,301 | 12/1964 | Cage | 206/534 |
| 3,251,459 | 5/1966 | Lacour | 206/42 |
| 3,326,433 | 6/1967 | Koch | 224/26 |
| 3,471,056 | 10/1969 | Kovac | 221/155 |
| 3,782,397 | 1/1974 | McCord | 132/84 A |
| 3,991,776 | 11/1976 | Duffy | 132/84 R |
| 4,140,140 | 2/1979 | Proia et al. | 132/84 B |
| 4,295,579 | 10/1981 | Haas | 221/229 |
| 4,465,191 | 8/1984 | Darbo | 206/537 |
| 5,020,671 | 6/1991 | Smith et al. | 206/534 |
| 5,365,956 | 11/1994 | Guadiana | 132/311 |
| 5,366,113 | 11/1994 | Kim et al. | 221/232 |

FOREIGN PATENT DOCUMENTS

| | | | |
|---|---|---|---|
| 2041576 | 2/1972 | Germany | 15/167.1 |
| WO91/16247 | 10/1991 | Japan | 221/2 |
| 406130625 | 5/1994 | Japan | 206/538 |

*Primary Examiner*—David Scherbel
*Assistant Examiner*—Terrence R. Till
*Attorney, Agent, or Firm*—Steven Lin

[57] ABSTRACT

A combination toothbrush and storage/dispenser apparatus 10 having a handle 30 with a hollow chamber 30A, a toothbrush head 20 attached to an end of the handle 30, and at least one tray 40 for storing articles which the at least one tray 40 slidingly inserts into and moves inside the hollow chamber 30A. The articles stored in the tray 40 can be pills 70. The combination apparatus 10 can further have a pill dispenser 50 that is integral with an end of the handle 30 for dispensing pills 70 from the tray 40. The pill dispenser 50 has a dispensing slot 51 through which the pills 70 are dispensed and a tray stop located near the dispensing slot 51 for stopping the tray 40 from further being removed from the handle 30 when a pill 70 is at the dispensing slot 51. The tray stop can be a deflectable tray stop 55 which allows the tray 40 that is loaded with pills 70 to be inserted into the hollow chamber 30A, but stops the movement of the tray 40 when a pill 70 is at the dispensing slot 51 ready to be dispensed. The combination apparatus 10 can also have an endcap 60 for securely engaging the tray 40 to the handle 30 and for encasing and providing a seal for pill dispenser 50. Furthermore, tray 40 can have attached to it a tear strip 80 or 85 which retain the pills 70 in a generally stationary position in the tray 40 before or during insertion of the tray 40 into the hollow chamber 30A.

15 Claims, 4 Drawing Sheets

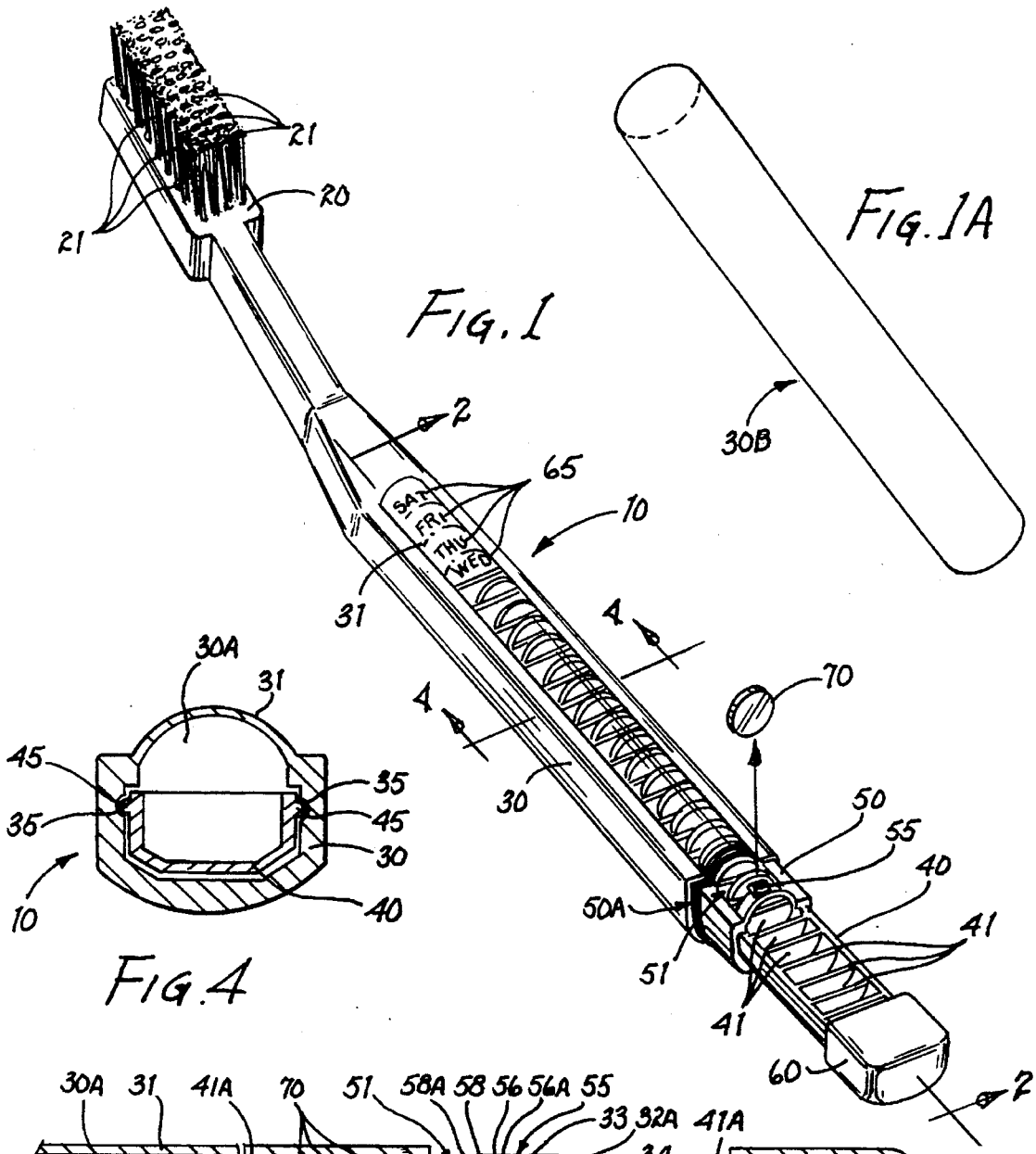
FIG. 1
FIG. 1A
FIG. 4
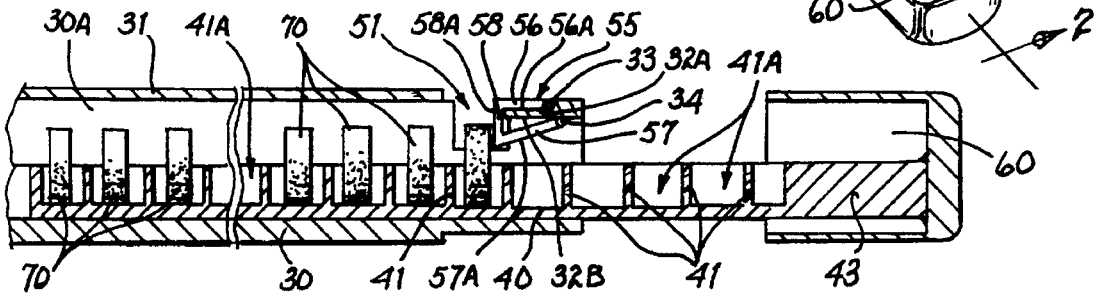
FIG. 2
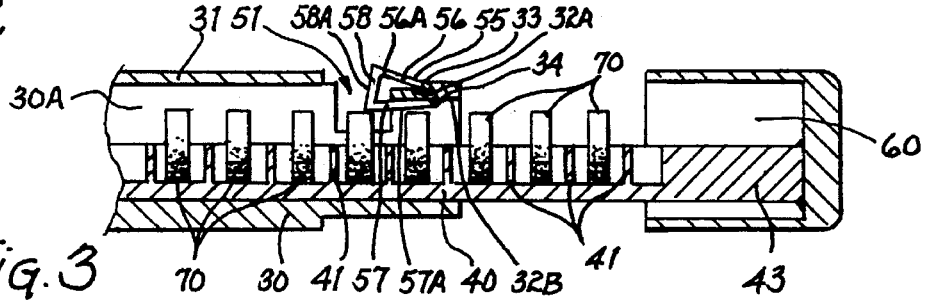
FIG. 3

COMBINATION TOOTHBRUSH AND STORAGE/DISPENSER APPARATUS AND METHOD OF MAKING THE SAME THEREOF

BACKGROUND OF THE INVENTION

1. Fields of the Invention

The present invention relates to a device that combines a toiletry with a storage or dispensing apparatus, and more particularly, relates to a device that combines a toothbrush with a pill storing or pill dispensing apparatus.

2. Discussion Of Background And Prior Art

A number of toiletties are used by people on a regular basis and are small enough in size so that they can be easily carded or packed for travel. There are advantages provided by combining a toiletry with a storage apparatus that can store various things. One advantage would be that the amount of space that the toiletry and the stored things occupy would be reduced and thus making it easier to pack them for travel. Another advantage would be that the toiletry that is used on a regular basis could function as a reminder system for the stored article. Furthermore, by storing items in a toiletry, these items may be more conveniently placed or accessible for the user.

One example of such a combination device is found in U.S. Pat. No. 4,140,140 to Proia et al. which discloses a combination toothbrush and pill dispenser. The combination device comprises a hollow handle having punch-through sheets of pills attached to its sides. The hollow handle has a plurality of openings on its sides to allow the user to depress pills and force them through the sheet and opening and into the hollow portion of the handle. The pills are then able to be dispensed out of the hollow portion of the handle. Since toothbrushes are typically used on a regular basis, the combination device is effective in reminding the user to also take the pill.

One of the disadvantages of the combination device, however, is that the pills can get trapped inside the hollow portion of the handle when they are being dispensed. Another disadvantage is that the combination device is set up such that the user could still accidentally dispense and take a pill out of the proper sequential order which could result in the taking of the wrong pill dosage. A further disadvantage is that when the user is gripping the handle of the toothbrush, the pills could accidentally be pushed through the sheets, resulting in the pills being unable to be reinserted and the proper order of the pills being unable to be recovered.

There are many types of pill dispensers in the prior art. U.S. Pat. No. 4,465,191 to Darbo and U.S. Pat. No. 3,251,459 to Lacour each disclose a pill dispenser that has a slideable tray that is used for dispensing pills. Advantages of using a slideable tray as a pill dispenser is that the pills can be easily accessed and refilled by the user, and that the tray can be set up so that the sequential order of the pills can be more easily maintained. Neither of these patents, however, disclose the use of a pill dispenser having a slideable tray in conjunction with a toothbrush or any other toiletry.

Another example of a combination toiletry and storage device is found in U.S. Pat. No. 3,782,397 to McCord ("WcCord") which discloses a combination toothbrush and dental floss dispenser in which a roll of dental floss is mounted inside the handle of the toothbrush. McCord, however, does not disclose the use of a slideable tray to dispense the floss or anything else.

There are some drugs that must be taken consistently at regular intervals in order to maintain its effectiveness. For example, contraceptive pills are typically prescribed to be taken on a one pill per day basis. Several types of contraceptive pill dispensers exist in the art. One type is a pitch-through sheet of pills in which the pills are sandwiched between a layer of foil and a layer of plastic, and the sheet has daily indices in order to label the pills. The user pushes and dispenses the pill through the foil that corresponds to the day indicated. Another type is a rotating dispenser having an individual chamber for each pill and wherein each individual chamber is labeled with a daily indicia. The user rotates a lid having a pill dispensing slot over the pill that corresponds to that day and dispenses the pill. Therefore, it is crucial that the user remembers and takes the proper pill each day, and a device that would aid in reminding the person to take the pill would further be desired. A toiletry used on a regular basis that is also capable of storing and dispensing pills could provide this reminder function.

Therefore, a toiletry that also has a storage function, and, in particular, a toothbrush that has a slideable storage/dispenser tray is desired, and it is an object of the present invention to overcome the problems and limitations of the prior art that has been discussed.

SUMMARY OF THE INVENTION

Set forth is a brief summary of the invention in order to solve the foregoing problems and achieve the foregoing and other objects, benefits, and advantages in accordance with the purposes of the present invention as embodied and broadly described herein.

Accordingly, it is an object and advantage of the present invention to provide a combination toiletry and storage apparatus that has a slideable tray.

It is one aspect and advantage of the present invention to provide a combination toothbrush and storage or dispenser apparatus having a handle with a hollow chamber, a toothbrush head attached to an end of the handle, and at least one tray for storing articles in which the tray slidingly inserts into and moves inside the hollow chamber.

It is a further aspect and advantage of the present invention to provide a combination toothbrush and storage apparatus that has pills and, in particular, oral contraceptive pills, stored in and dispensed from the tray.

It is a further aspect and advantage of the present invention to provide a combination toothbrush and storage apparatus that has a pill dispenser that is attached and made part of the handle for dispensing pills from the tray.

It is a further aspect and advantage of the present invention to provide a combination toothbrush and storage apparatus having a tray that is divided in a plurality of sections in which each section can hold at least one article.

It is a further aspect and advantage of the present invention to provide a combination toothbrush and storage apparatus that has a handle that comprises at least one transparent side for allowing the article in each section of the tray to be visible to the user and on which indices are placed to correspondingly label each section of the tray.

It is another aspect and advantage of the present invention to provide a method of making a combination toothbrush and storage device that involve the steps of providing a handle with a hollow chamber, attaching a toothbrush head to an end of the handle, and sliding at least one tray for storing articles inside the hollow chamber.

It is still another aspect and advantage of the present invention to provide a combination toothbrush, pill-dispenser, and pill-taking reminder device comprising a handle having a hollow chamber and a transparent side, a toothbrush head attached to an end of the handle, a tray which pills are stored in and dispensed from that has a plurality of sections wherein each section stores at least one pill and wherein the tray slidingly inserts into and moves inside the hollow chamber so that the pills in the sections are visible through the transparent side, and indices located on the transparent side that correspondingly function as a reminder label for each section.

BRIEF DESCRIPTION OF THE DRAWINGS

FIG. 1 - Perspective view of the preferred embodiment of the combination toothbrush and storage/dispenser apparatus.

FIG. 2 - Side view of the handle portion of the combination toothbrush and storage/dispenser apparatus of FIG. 1 showing the deflectable tray stop in the resting position.

FIG. 3 - Side view of the handle portion of the combination toothbrush and storage/dispenser apparatus of FIG. 1 showing the deflectable tray stop in the deflecting position.

FIG. 1A - Perspective view of a handle sheath made of an opaque material that slides over the handle of the combination toothbrush and storage/dispenser apparatus.

FIG. 4 - Cross sectional view of the combination toothbrush and storage/dispenser apparatus taken along the line 4—4 of FIG. 1.

DETAILED DESCRIPTION OF THE PREFERRED EMBODIMENT

Figure 5:
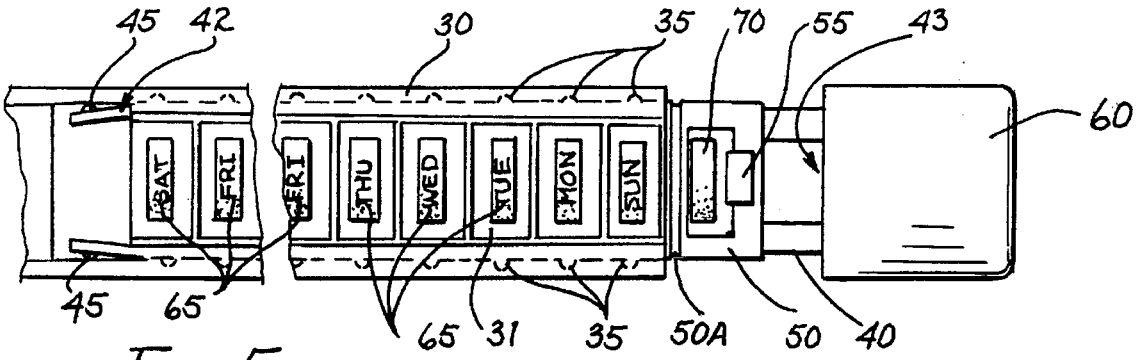
FIG. 5 - Top view of the handle portion of the combination toothbrush and storage/dispenser apparatus of FIG. 1.
Figure 6A:
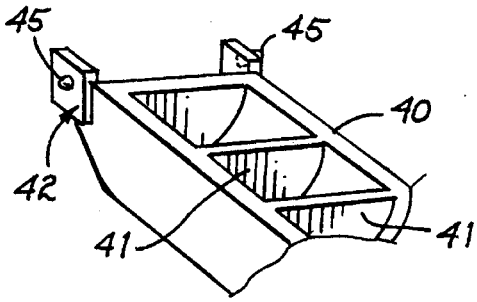
FIG. 6A - Perspective view of part of the tray that slides inside the handle of the combination apparatus of FIG. 1 showing the protuberances that engage into the detents that are inside the hollow chamber of the handle.
Figure 6:
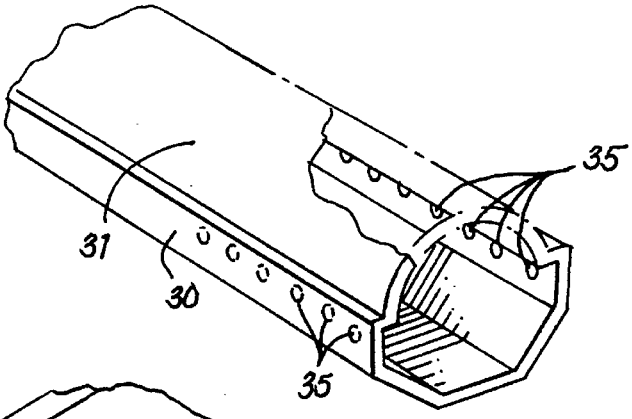
FIG. 6 - Perspective view of part of the handle of the combination apparatus of FIG. 1 showing the detents located inside the hollow chamber of the handle that are engaged by the protuberances of the tray.

The present invention generally discloses a toiletry that also has a storage or dispensing function. In particular, FIG. 1 shows a combination toothbrush and storage/dispenser apparatus 10. Combination apparatus 10 generally has a hollow handle 30 having a hollow chamber 30A, a toothbrush head 20 with bristles 21 attached to the handle 30, and a tray 40 which stores various articles that slides or moves inside the handle 30. Tray 40 can be used to store pills 70, and combination apparatus 10 can further comprise a pill dispenser 50 for dispensing the pills 70 from the tray 40. Pills 70 can be oral contraceptive pills or any other type of medical pills.

As shown in FIGS. 1—3, tray 40 has a number of divider walls 41 for dividing the tray 40 into a plurality of sections or compartments 41A in which each section or compartment 41A can hold at least one article (i.e. at least one pill 70). FIG. 3 shows the tray 40 filled with pills 70, and the tray 40 is being inserted into the hollow chamber 30A of handle 30. The pill dispenser 50 is shown to be attached to and made part of an end of the handle 30 (i.e. made an integral part of the handle). The pill dispenser 50 has a dispensing slot 51 through which a pill 70 is dispensed. The dispensing slot 51 can be made wide enough to dispense one or several pills at a time.

In FIGS. 1–3, pill dispenser 50 also has a tray stop 55 located near the dispensing slot 51. Tray stop 55 is a deflectable tray stop that allows the tray 40 that is filled with pills 70 to be inserted into handle 30, but stops the further movement or removal of the tray 40 from the handle 30 to allow pills 70 to be dispensed one or several at a time through the dispensing slot 51. Deflectable tray stop 55 is a structure that is hingedly attached to the hollow handle 30 in at least two locations a distance apart. FIGS. 2 and 3 show that the tray stop 55 is hingedly attached to the handle 30 at location 33 and location 34. Tray stop 55 has an engaging side 56, a deflecting side 57, and a stopping side 58. As shown in FIGS. 2–3, one end of engaging side 56 is hingedly attached to the handle 30 at location 33, and the other end of engaging side 56 is attached to an end of stopping side 58. Furthermore, one end of deflecting side 57 is hingedly attached to the handle 30 at location 34, and the other end of deflecting side 57 is attached to another end of stopping side 58. Before the tray 40 is inserted into the hollow chamber 30A of handle 30, the deflectable tray stop 55 is in a resting position (i.e. see position of tray stop 55 in FIG. 2). In this resting position, the engaging side 56 has an inner surface 56A that rests on or is in contact with an outer surface 32A of the handle 30. Also, when the tray stop 55 is in the resting position, the deflecting side 57 is in a downwardly, angled, stationary position generally inside the hollow chamber 30A and the stopping side 58 is in a vertical position also generally inside the hollow chamber 30A.

The tray stop 55 is pivotally deflected from a resting position to a deflecting position by the pills 70 loaded into tray 40 to allow tray 40 to be inserted into the hollow handle 30 (i.e. see FIG. 3). In this deflecting position, the deflecting side 57 has a deflecting surface 57A, that is contacted and deflected by the pills 70, and the deflecting side 57 is deflected upwardly towards the surface 32B of the handle 30. The engaging side 56 and the stopping side 58 swing outwardly from the hollow handle 30 (i.e. the respective ends of these sides pivot at locations 33 and 34). The deflectable tray stop 55 returns to the resting position (i.e. see position of tray stop 55 in FIG. 2) after all of the pills 70 in the tray 40 that is being inserted into the handle 30 deflect the tray stop 55. The tray 40 can slide inside the handle 30 and can be moved to a position in which a pill 70 can be dispensed from the pill dispenser 50. The tray stop 55 remains in the resting position to stop the tray 40 from further being removed from the hollow handle 30 when at least one pill 70 is at dispensing slot 51 ready to be dispensed. The tray 40 is stopped from further being removed from the handle 30 by sandwiching the pill(s) 70 at dispensing slot 51 between the stopping surface 58A of stopping side 58 and the corresponding divider wall 41 when the tray 40 is being pulled from the handle 30 as shown in FIGS. 2–3. Pills 70 are dispensed by removing them from the dispensing slot 51 (i.e. pills can be removed by tipping the apparatus 10 on its side and letting the pill(s) 70 roll out of the tray 40). Combination apparatus 10 with tray stop 55 also allows the user to refill pills 70 into tray 40.

The combination apparatus 10 as shown in FIGS. 1–3 and 5 further has an endcap 60. The endcap 60 is attached to end 43 of the tray 40. The endcap 60 functions to securely engage the tray 40 to the hollow handle 30 after the tray 40 is inserted into the hollow handle 30. As shown in FIGS. 1 and 5, endcap 60 fits snugly over the pill dispenser 50 and engages into a sealing groove 50A, that is located between the main part of the handle 30 and the pill dispenser 50, to function as a seal (i.e. a water-tight seal) for the pill dispenser 50.

In order to dispense a pill, the user pubs the end cap 60 which in effect slides the tray 40 from the handle 30 until a pill 70 reaches the dispensing slot 51. As stated earlier, tray stop 55 allows tray 40 to be pulled out of handle 30 only far enough for the pill(s) 70 to be dispensed. After the pill(s) 70 have been dispensed, the tray 40 is re-inserted or pushed back into handle 30 and endcap 60 re-engages the tray 40 to the handle 30 and re-encases the pill dispenser 50 coveting the dispensing slot 51.

The hollow handle 30 of the combination apparatus 10 also has a transparent side 31 along the length of the handle 30 as shown in FIGS. 1–3 and 5. The transparent side 31 allows the articles stored in each section of the tray 40 to be visible to the user (i.e. visible through the handle 30). Indices 65 are placed on the transparent side 31 to correspondingly label each section of the tray 40. For example, in FIGS. 1 and 5, when tray 40 is entirely inserted into handle 30, an indicia 65 aligns with a corresponding pill 70 in tray 40 and indicates the day of the week that the corresponding pill 70 is to be taken. These indices 65 can be supplied on removable labels. The removeable labels are placed on the transparent side 31, and these labels can be removed and correspondingly replaced so that the indices 65 can be reset for each new supply of pills 70 that are loaded into tray 40.

There are some pills 70 which should not be generally exposed to light when they are stored. Light, therefore, needs to be prevented from passing through transparent side 31 when combination apparatus 10 is not being used. FIG. 1A shows a handle sheath 30B, which is made of an opaque material, that slides over handle 30 coveting the transparent side(s) 31. Handle sheath 30B prevents light from passing through the transparent side 31 and, in effect, to the pills 70 when sheath 30B is placed over handle 30.

Combination apparatus 10 can further have a plurality of detents 35 along two inner sides of the hollow handle 30 as shown in FIGS. 4, 5, 6 and 6A. Two protuberances 45 are exteriorly located on the side of tray 45 at end 42 (i.e. the end that is initially inserted into handle 30). The protuberances 45 engage the detents 35 to interrupt the sliding of the tray 40 at each section. This feature can further ensure that the pills 70 are dispensed from each section 41A one or several at a time by allowing each section 41A of tray 40 to innterruptingly slide to the dispensing slot 51.

Figure 7:
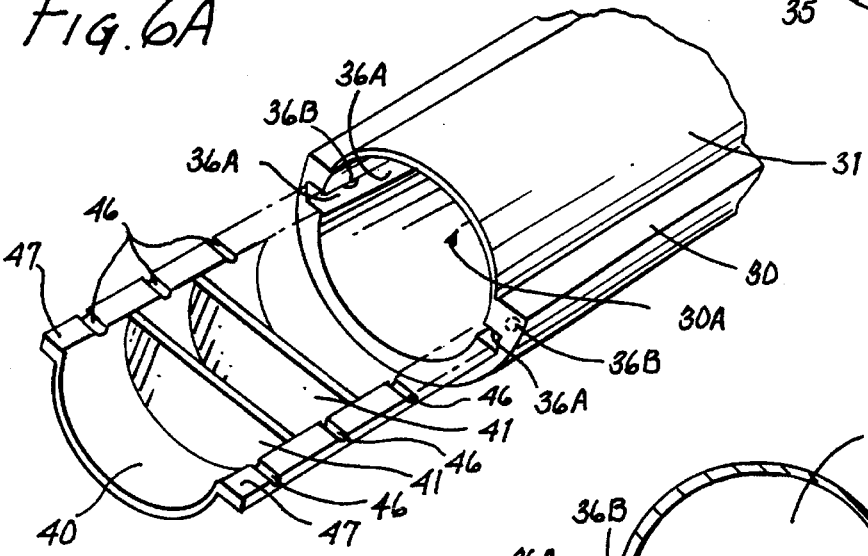
FIG. 7 - Perspective view of part of a second embodiment hollow handle and a second embodiment tray in which the hollow handle has grooves and protuberances for respectively receiving and engaging the rails and the detents of the tray.
Figure 8:
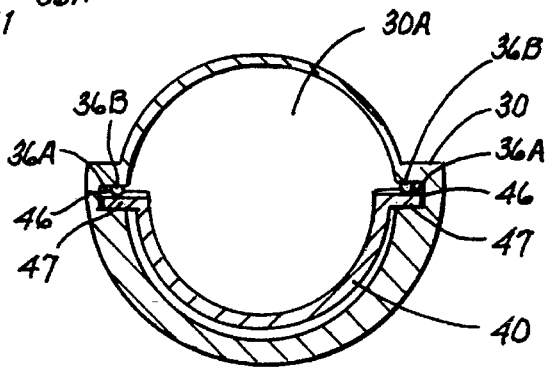
FIG. 8 - Cross sectional view of the second embodiment hollow handle and the second embodiment tray of FIG. 7.

FIGS. 7–8 show a second embodiment hollow handle 30 and a second embodiment tray 40. The handle 30, in these figures, has two grooves 36A along the length of the inner sides of the hollow chamber 30A. Tray 40 further has at its sides two lengthwise, flat rails 47, and the two rails 47 correspondingly insert and engage into the two grooves 36A when the tray 40 is inserted into the hollow chamber 30A. A protuberance 36B is located in an inner top portion of each rail 36A near the inserting end of the handle 30. A plurality of detent grooves 46 are located along the length of the rails 47 on the top sides of the rails 47. The protuberances 36B engage the detent grooves 46 of the tray 40 to interrupt the sliding of the tray 40 at each section.

Figure 9:
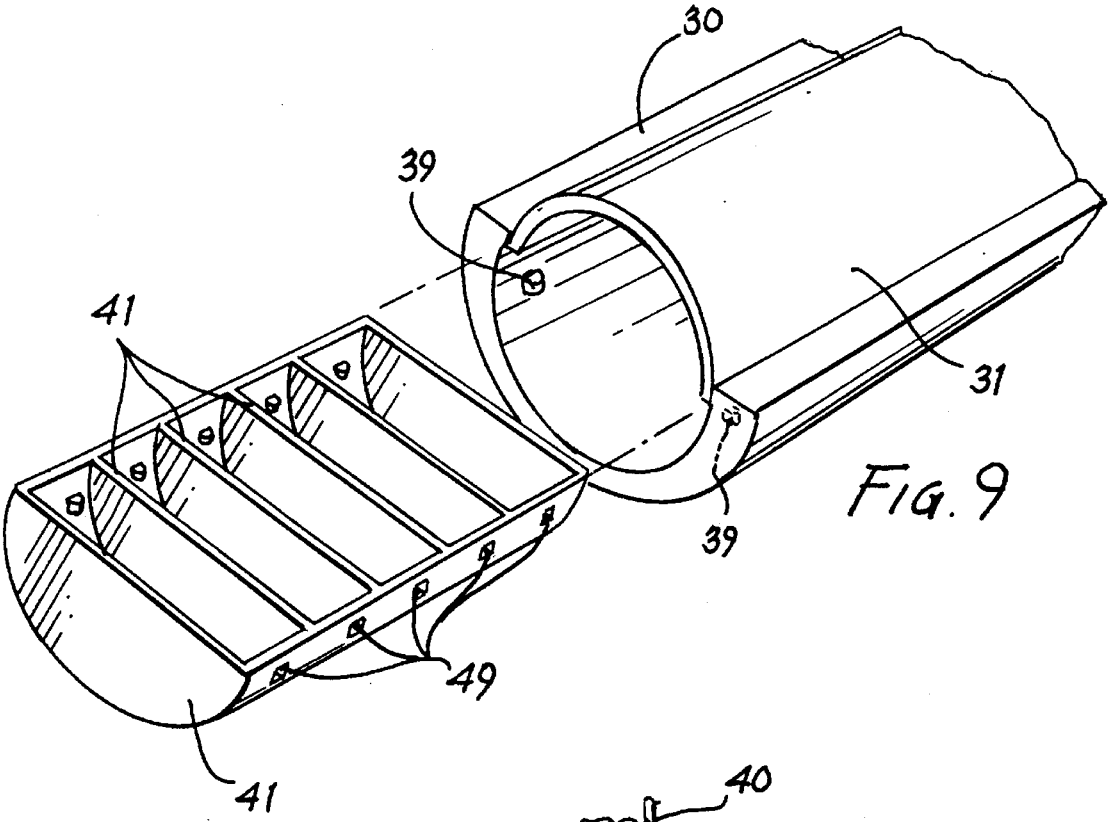
FIG. 9 - Perspective view of part of a third embodiment hollow handle and a third embodiment tray in which the hollow handle has protuberances that engage detents located along the sides of the tray.
Figure 9A:
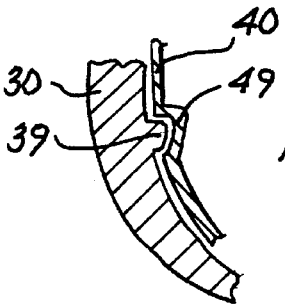
FIG. 9A - Partial cross sectional view of part of the third embodiment hollow handle and the third embodiment tray of FIG. 9 showing a protuberance of the hollow handle engaging a detent of the tray.

FIG. 9 and 9A show a third embodiment hollow handle 30 and a third embodiment tray 40. The handle 30, in these figures, has two protuberances 39 located in the inner sides near the inserting end of the handle 30. Tray 40 is shown to have a plurality of detents 49 located along the length of the sides of tray 40. The protuberances 39 of handle 30 engage the detents 49 of tray 40 to interrupt the sliding of the tray 40 at each section. The features of the second and third embodiment handles 30 and trays 40 also ensure that the pills 70 are dispensed from each section 41A one or several at a time by allowing each section 41A to interruptingly slide to the dispensing slot 51.

The hollow chamber 30A of handle 30 and tray 40 are designed so that the tray 40 does not rotate within the hollow chamber 30A. FIGS. 1, 4, 6, and 6A show the tray 40 with beveled sides that slide into corresponding beveled surfaces in the hollow chamber 30A so that the tray 40 is prevented from being rotated within the hollow chamber 30A. FIGS. 7 and 8 show tray 40 with two lengthwise flat rails 47 and hollow chamber 30A having two grooves 36A. The two rails 47 correspondingly insert and engage into the two grooves 36A so that the tray 40 is prevented from being rotated within the hollow chamber 30A. FIGS. 9 and 9A show the tray 40 with a semi-circular cross section. Tray 40 has lengthwise, top edges that correspondingly contact lengthwise, inner sides located in the hollow chamber 30A to prevent the tray 40 from rotating within the hollow chamber 30A. For these above embodiments that have just been discussed, it is important to prevent the tray 40 from rotating within the hollow chamber 30A so that the pills 70 can be properly viewed through the transparent side 31 and so that the pills 70 can be dispensed properly through the dispensing slot 51.

Figure 10:
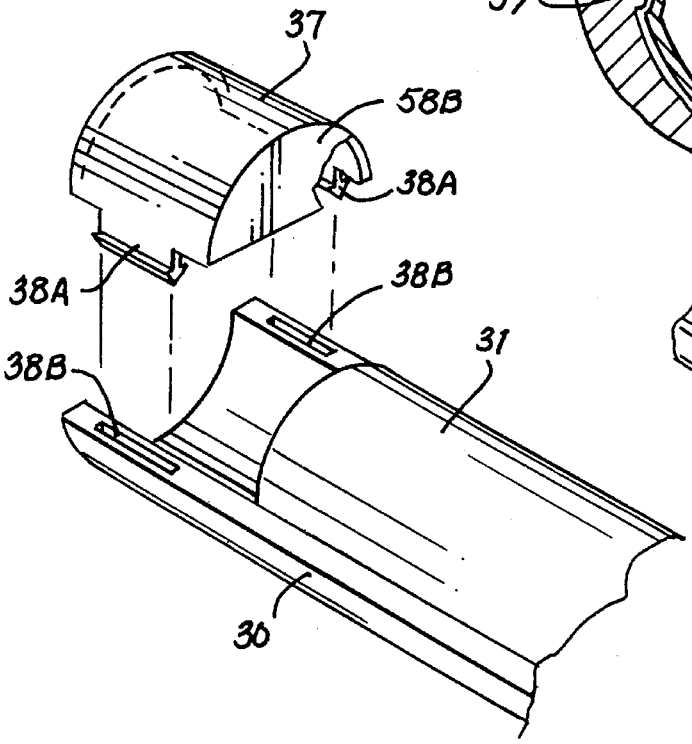
FIG. 10 - Perspective view of a second embodiment tray stop and corresponding hollow handle.
Figure 11A:
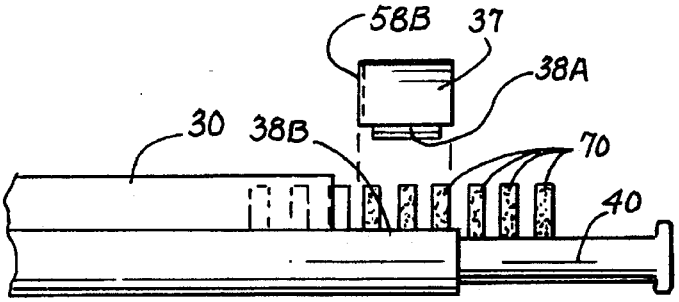
FIG. 11A - Side view of the second embodiment tray stop and corresponding handle of FIG. 10 showing the tray being first inserted into the hollow handle.
Figure 11B:
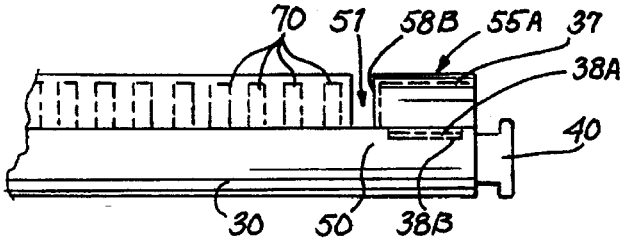
FIG. 11B - Side view of the second embodiment tray stop and corresponding hollow handle of FIG. 10 showing a dispensing slot formed and a tray stop structure attached after the tray is inserted into the hollow handle.

FIGS. 10, 11A, and 11B show a second embodiment tray stop 55A and corresponding handle 30. FIG. 11A shows that the tray 40 filled with pills 70 is first inserted into the hollow chamber 30A of handle 30. FIG. 11B shows that a tray stop structure 37 is then mounted and secured to the handle 30 by inserting tabs 38A of structure 37 into corresponding slots 38B of handle 30. FIG. 10 shows that tabs 38A are locking tabs which lock into the slots 38B to secure the structure 37 to handle 30. Alternatively, tabs 38A can be adhesively attached to the handle 30. The tray stop structure 37 is shown to form the dispensing slot 51 and also provides the stopping side 58B to stop the movement of the tray 40 when a pill 70 is at the dispensing slot 51.

Figure 15:
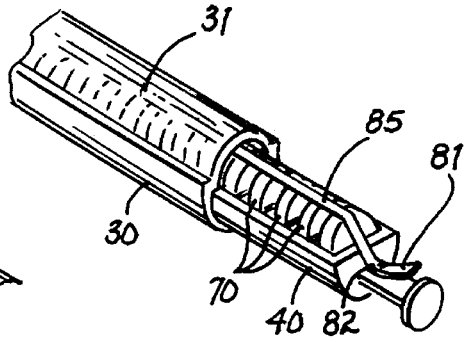
FIG. 15 - Perspective view of a tray having a second embodiment tear strip attached along the top of the tray for retaining pills in the tray and further showing the tray as being inserted into the hollow chamber of the handle.
Figure 12:
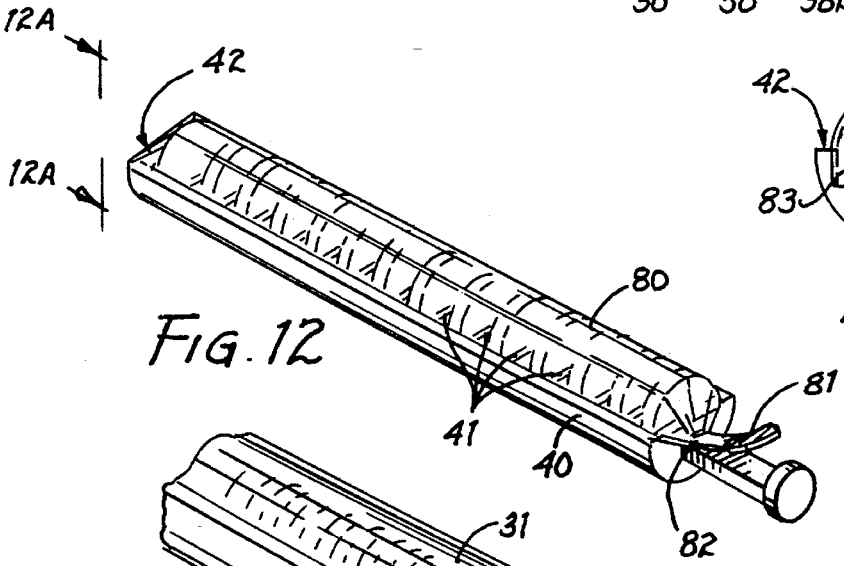
FIG. 12 - Perspective view of a tray that is inserted into the hollow handle of the combination apparatus showing a first embodiment tear strip attached along the top of the tray for retaining pills in the tray.
Figure 12A:
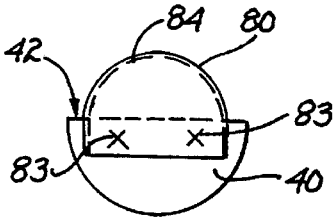
FIG. 12A - Perspective view of the tray according to the line 12A—12A of FIG. 12.
Figure 13:
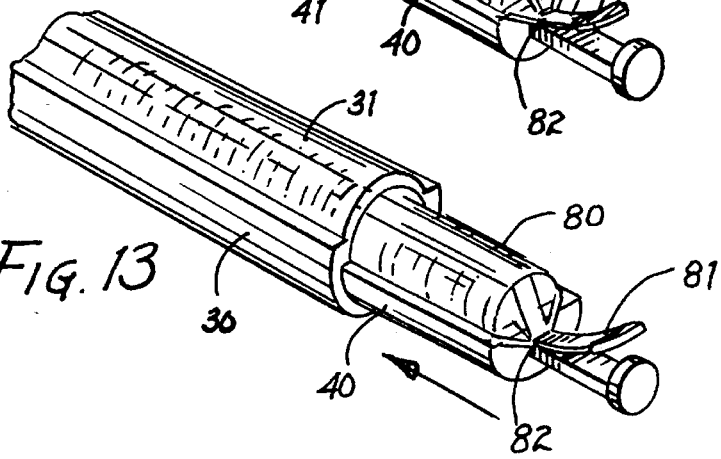
FIG. 13 - Perspective view of the tray shown in FIG. 12 inserted into a hollow handle.
Figure 14:
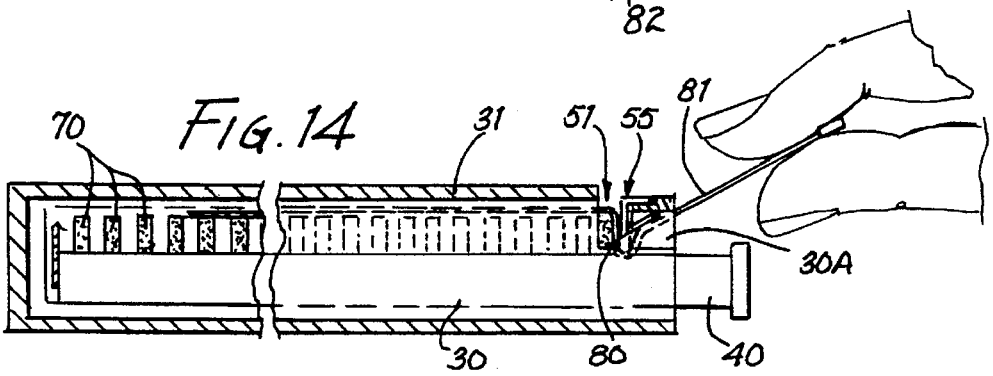
FIG. 14 - Side view of the tray of FIG. 12 with the first embodiment tear strip inserted into the hollow chamber of the handle and further showing the tear strip fitted underneath the tray stop and through a hollow end of the handle.

Combination apparatus 10 can further have the feature of a tear strip 80 that is attached to the top portion of tray 40. As shown in FIGS. 12, 12A, 13, and 14, tear strip 80 entirely covers the pills 70 and the top lengthwise portion of tray 40. Tear strip 80 is attached adhesively to tray 40 at locations 82 and 83 as shown in FIGS. 12 and 12A. FIG. 14 shows tray 40 with the tear strip 80 inserted into the handle 30. Tear strip 80 fits snugly under the tray stop 55 and through the hollow end 30A of handle 30. The user can then pull the tab 81 which would result in the tear strip 80 being detached, pulled through, and removed from the handle 30. For easier detachment of the tear strip from the tray 40, FIG. 12A shows the tear strip 80 having perforations 84 located near end 42 of tray 40. FIG. 15 shows a second embodiment tear strip 85 which is the same as the first embodiment tear strip 80 except that the tear strip is a narrower strip that only covers a narrower part of the top lengthwise portion of the tray 40. Tear strips 80 and 85, however, both function to retain the pills 70 in a generally stationary position in the tray 40 before or during the inserting of the tray 40 into handle 30.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A combination toothbrush and storage apparatus comprising:

a handle having a hollow chamber, a toothbrush head attached to an end of the handle, and at least one tray adapted to store articles wherein the at least one tray slidingly inserts into and moves inside the hollow chamber of the handle and wherein the at least one tray further has a plurality of divider walls for dividing the at least one tray into a plurality of sections wherein each section can hold at least one article.

2. The combination toothbrush and storage apparatus according to claim 1 wherein the at least one tray is adapted to store pills.

3. The combination toothbrush and storage apparatus according to claim 1 wherein the handle further comprises:

at least one transparent side for allowing the at least one article in each section of the at least one tray to be visible through the handle, and indices located on the transparent side to correspondingly label each section.

4. The combination toothbrush and storage apparatus according to claim 1:

wherein the handle further comprises at least one detent that is placed inside the handle at a corresponding location for each section of the at least one tray, and wherein the at least one tray further comprises at least one protuberance exteriorly located near an end of the at least one tray that is initially inserted into the handle to engage the at least one detent so that the sliding of the at least one tray is interrupted at each section.

5. The combination toothbrush and storage apparatus according to claim 2 wherein the at least one tray is adapted to store oral contraceptive pills.

6. The combination toothbrush and storage apparatus according to claim 2 further comprises:

a pill dispenser attached to and made part of an end of the handle for dispensing the pills from the at least one tray.

7. The combination toothbrush and storage apparatus according to claim 6 further comprises:

an endcap attached to an end of the at least one tray for securely engaging the at least one tray to the handle and for providing a seal for the pill dispenser.

8. The combination toothbrush and storage apparatus according to claim 6 wherein the at least one tray can be moved to a position in which at least one pill in the at least one tray can be dispensed from the pill dispenser, and wherein the pill dispenser comprises:

a dispensing slot located in the handle through which the pills can be dispensed, and a tray stop having a stopping surface located near the dispensing slot that stops the at least one tray from further sliding from the handle by sandwiching the at least one pill between the stopping surface and a wall of the at least one tray when the at least one pill is at the dispensing slot.

9. The combination toothbrush and storage apparatus according to claim 8 wherein the tray stop is a deflectable tray stop, that is initially mounted in a resting position in the handle near the dispensing slot, that is deflected from the resting position to a deflecting position by the pills that are loaded into the at least one tray when the at least one tray is being inserted into the handle, that returns to the resting position after the pills in the at least one tray that is being inserted into the handle have deflected the tray stop, and that remains in the resting position to stop the at least one tray from further being removed from the handle when the at least one pill is at the dispensing slot ready to be dispensed.

10. The combination toothbrush and storage apparatus according to claim 6 further comprises:

a tear strip, attached over the pills and to the at least one tray, which retains the pills in a generally stationary position in the at least one tray before or during the insertion of the at least one tray into the handle.

11. The combination toothbrush and storage apparatus according to claim 9 wherein the deflectable tray stop is a hinged structure that is hingedly attached to the handle in at least two places a distance apart and wherein the hinged structure further comprises:

an engaging side, that has an end hingedly attached at one place in the handle, that has an inner surface that engages and is in contact with an outer surface of the handle when the tray stop is in the resting position, and that swings outwardly from the hollow chamber of the handle when the tray stop is in the deflecting position, a deflecting side, that has one end hingedly attached at another place in the handle, that has a deflecting surface that deflects towards an inner surface of the handle when the tray stop is in the deflecting position, and that remains in a stationary position when the tray stop is in the resting position, and a stopping side, that has one end attached to an end of the deflecting side, that has another end attached to an end of the engaging side, and that comprises the stopping surface which remains in the hollow chamber when the tray stop is in the resting position so that the at least one pill can be sandwiched between a wall of the at least one tray and the stopping surface to stop the at least one tray from further being removed from the at least one tray and which swings outwardly from the hollow chamber when the tray stop is in the deflecting position.

12. The combination toothbrush and storage apparatus according to claim 6 wherein the at least one tray is first loaded with pills, wherein the at least one tray is then inserted entirely into the handle, wherein the pill dispenser is integrally attached to the handle for allowing the pills to be dispensed from the at least one tray, and wherein the at least one tray can then be moved to a position in which at least one pill in the at least one tray can be dispensed from the pill dispenser.

13. The combination toothbrush and storage apparatus according to claim 12 wherein the pill dispenser further comprises a tray stop structure attached to the handle wherein the tray stop structure comprises a side that forms a part of the dispensing slot and that has a stopping surface that is used to stop the at least one tray from further being removed from the handle.

14. A combination toothbrush, pill-dispenser, and pill-taking reminder device comprising:

a handle having a hollow chamber and a transparent side, a toothbrush head attached to an end of the handle, a tray which pills are stored in and dispensed from that has a plurality of sections wherein each section stores at least one pill and wherein the tray slidingly inserts into and moves inside the hollow chamber so that the pills in the sections are visible through the transparent side, and indices located on the transparent side that correspondingly function as a reminder label for each section.

15. A combination toothbrush and storage apparatus having:

a handle with a hollow chamber, a toothbrush head attached to an end of the handle, at least one tray adapted to store pills wherein the at least one tray slidingly inserts into and moves inside the hollow chamber of the handle, and a pill dispenser attached to and made part of an end of the handle for dispensing the pills from the at least one tray.

* * * * *